US006203220B1

(12) United States Patent
Takenoshita et al.

(10) Patent No.: US 6,203,220 B1
(45) Date of Patent: Mar. 20, 2001

(54) METHOD, APPARATUS, AND PROGRAM FOR PRINTING USING MODIFIED PRINT ATTRIBUTES

(75) Inventors: Hiroyuki Takenoshita, Sagamihara; Tsutomu Sawa, Fujisawa, both of (JP)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/280,237

(22) Filed: Mar. 29, 1999

(30) Foreign Application Priority Data

Mar. 27, 1998 (JP) ..... 10-080698

(51) Int. Cl.[7] ..... B41J 5/30

(52) U.S. Cl. ..... 400/61; 235/375; 399/82; 399/85; 399/361; 399/376; 345/118; 707/520

(58) Field of Search ..... 400/61, 62, 70, 400/73, 76, 120.09, 120.13, 120.12; 235/375; 399/81, 85, 82, 144, 361, 376; 345/118, 349; 703/520, 500, 513

(56) References Cited

U.S. PATENT DOCUMENTS 4,983,053 * 1/1991 Tsuki ..... 400/62
5,050,099 * 9/1991 Nishihara ..... 400/62
5,718,520 * 2/1998 Mackay ..... 400/61
5,835,820 * 11/1998 Martin et al. ..... 399/85
5,872,569 * 2/1999 Salgado et al. ..... 399/82
5,878,198 * 3/1999 Yuasa et al. ..... 358/1.18
5,892,512 * 4/1999 Downelly et al. ..... 349/345
5,923,013 * 7/1999 Suzuki et al. ..... 235/375
5,997,131 * 12/1999 Kohno ..... 347/40
5,999,945 * 12/1999 Lahey et al. ..... 707/200
6,017,113 * 1/2000 Nicoloff, Jr. et al. ..... 347/40

FOREIGN PATENT DOCUMENTS 87-248659 10/1987 (JP) .
92-173255 6/1992 (JP) .
92-217257 8/1994 (JP) .

* cited by examiner

*Primary Examiner*—Eugene Eickholt
(74) *Attorney, Agent, or Firm*—David W. Victor; Konrad Raynes & Victor LLP

(57) ABSTRACT

The present invention provides a printer system responsive to the request of an operator for performing specified control on a specified portion of a medium during a print operation. Such control minimizes the labor required by an operator to change the set-up condition of the printer when different print media is used. Print operations having modified print attributes for specified areas are set-up for each type of media in advance and stored in a storage device of a printer or a host processor for controlling the printer, such as a personal computer or a server. When a medium is inserted into the printer, medium identifying information, such as a bar coded form number or the size of the medium is used to determine which record stored in the storage device corresponds to the selected medium. The controlled print operation, such as a high print pressure printing, a high quality printing, a change or modification of line/column space, or a modification of font, is made in the area specified by the position data.

24 Claims, 10 Drawing Sheets

TABLE 1

| ATTRIBUTES | DESCRIPTION | PRIORITY |
|---|---|---|
| PRINT PRESSURE | HIGH PRINT PRESSURE | 1 |
| | NORMAL PRINT PRESSURE | 2 |
| PRINT QUALITY | QUALITY | 1 |
| | NORMAL | 2 |
| | DRAFT | 3 |
| PRINT PITCH | 12CPI | 1 |
| | 10CPI | 2 |
| LINE FEED | 5LPI | 1 |
| | 6LPI | 2 |
| FONT | MINCHO (JAPANESE FONT) | 1 |
| | GOTHIC | 2 |

FIG. 10

METHOD, APPARATUS, AND PROGRAM FOR PRINTING USING MODIFIED PRINT ATTRIBUTES

BACKGROUND OF THE INVENTION

1. Field of the Invention

The present invention relates to impact printers, and more particularly, to a scheme for controlling print attributes in impact printers.

2. Description of the Prior Art

Various types of print media are often used by financial institutions when printing. Printing may be performed on a thin print medium such as a single sheet of paper, a thick print medium such as a pressure sensitive paper stack or a carbon paper stack including more than four sheets, or a passbook including multiple pages. In order to maintain the desired print quality when printing onto thick print media or passbooks including more than two pages, it is necessary to print them by setting the print pressure to a level which is higher than that used for thin print medium including one or two sheets.

Conventional printers set the print pressure to an optimum print pressure (1) by using an expensive sensor which senses a thickness of the inserted print paper, (2) by using a lever which is selectively moved by an operator to adjust the distance between a print head and the print paper, (3) by rewriting set-up conditions to a print operation, such as the drive pulse width applied to the print head, which are stored in a flash memory in the printer, or (4) by specifying the set-up condition by a command from a host personal computer (PC).

A drawback of conventional printers is that after the print condition specifying the high print pressure is set, all types of media are printed with the high print pressure settings. Furthermore, if the print operation using the high print pressure is continuously used on the thin print medium, several problems are likely to occur.

The high print pressure requires increased power consumption as compared to a lower print pressure resulting in a temperature increase of the print head. To minimize the increase in temperature, a print operation is frequently suspended which often lowers the performance of a print operation. Additionally, the cost is increased due to the use of a cooling fan. Also, the high temperature often causes erroneous operations in the circuit cards and damages the print head.

Additionally, the life time of a print ribbon is shortened by high print pressure when the ink ribbon fiber is weakened as a result of ink loss in an early stage. As a result of the weakened fiber in the ink ribbon, the elasticity of the ink ribbon is lost. This may cause the ink ribbon to catch a wire in the print head resulting in a jam.

The high print pressure reduces the life time of the print head by increasing the wear of print wires at its ends and core. This causes the distance between the print wires and the medium to be enlarged which then requires the mount position of the print head to be adjusted frequently. When the enlarged distance is not reduced by adjusting of the mount position, the print head must be replaced.

The high print pressure often damages the surface of a platen. The platen is usually made of a material such as a rubber, aluminum, and CFRP (Carbon Fiber Reinforced Plastics). If a print operation using high print pressure is used on the thin print paper, a dent is likely to be formed on the surface of the platen due to the impact force of the print wires. This may cause the print paper to jam by catching the ink ribbon on the print wire leading to the deterioration of print quality and the breaking of the print wires. Furthermore, when using a movable platen mechanism going up and down, the platen should have the proper weight thereby limiting the material used for the platen. This may be a significant problem for this type of printer.

Another disadvantage of using high print pressure on thin print paper is the loud sound produced which may be noisy for the operator.

A print operation using high print pressure often damages thin paper by making holes in the thin paper. Because air layers are formed in the thick pressure sensitive paper stack or the carbon paper stack including multiple sheets (e.g., a voucher) and the passbook, particularly, a center portion of a lateral type passbook (in the case of the passbook conforming to a JIS standard as shown in FIG. 2, a portion between a line 12 and a line 13), the air is released from the air layers during the print operation by a strong pressure force applied by a platen 105 and a bar back or a bar member 103, as shown in FIG. 1. If the pressure force is increased too much, it may cause the carbon papers or the pressure sensitive papers to generate color. Thus, the pressure force is often limited by the number of sheets of the passbook and printing the characters at a location which does not overlap with the air layer. A folding portion of a vertical type passbook shown in FIG. 3 also causes the same type problem as that in the lateral type passbook. This problem cannot be solved by the mechanism of the platen and the bar back.

Various approaches for addressing the drawbacks associated with using high print pressure for all media types are described in Japanese published unexamined patent applications (PUPA) 61-217257, 4-173255 and 62-248659. PUPA 61-217257 relates to a driving scheme of the print head for changing the amount of energy applied to the print head when printing one line while taking into consideration the position of the print head along this one line. For this scheme, detection means is used to detect the difference in the print condition in the print position, such as a switch, a pressure sensor, an optical sensor, etc. Furthermore, the detected difference is provided to a print head control circuit.

However, a printer using this scheme has the following drawbacks due to the fact that it is designed to simultaneously print two types of print papers.

(1) The print pressure can be changed during the print operation of only one line. In other words, it is impossible to print the two types of print paper at the high print pressure or normal print pressure.

(2) In the case where the paper size is changed to change the print pressure, the mount position of the switch sensor for sensing the paper must be changed for each paper size.

(3) It is impossible to specify a particular print area, such as one character or one particular line, which requires the high print pressure.

(4) Types of print papers to be printed at the high print pressure are limited since the position for sensing the print paper is fixed.

PUPA 4-173255 describes a scheme where the print pressure for printing a particular area or scope of the print medium having a different material or thickness than the remaining area is increased by inputting coordinate values of that particular area. However, this scheme has the following drawbacks.

(1) It is difficult to determine whether the current print paper requires the high print pressure, or not. That is, this scheme is effective only when media requiring high print pressure are continuously fed.

(2) In the case where print papers having different sizes require high print pressure, the scope requiring the high print pressure is not specified for each paper size.

(3) To set the scope requiring the high print pressure, it is necessary to input the coordinate values via a keyboard. The scope can not be automatically set by insertion of the print paper to the printer.

PUPA 62-248659 describes a scheme where the print pressure is changed in accordance with a detect signal indicating the existence/nonexistence of a validation print paper at a predetermined set position. In this scheme, however, the same problems associated with PUPA 61-217257 apply because the print operation of a validation print paper and a journal print paper is performed on the same print line.

Conventional printers also have drawbacks associated with the high quality print operations. That is, three carrier speeds of the print head, i.e. a normal speed, a double speed and a triple speed are used in conventional impact printers. The double speed print operation is accomplished by reducing the dot density of the print head to a half value in comparison to the dot density used in the normal speed. The reduction of the dot density apparently degrades the print quality.

In the case where high print quality is required for only a particular portion, such as a particular line(s) or a particular column(s), conventional printers require the whole page to be printed in a high quality print mode, due to the fact that this printer can not specify the particular portion to be printed in the high print mode.

SUMMARY OF THE INVENTION

It is an object of preferred embodiments to provide a print control scheme for printing within at least one area of a selected medium with modified print attributes such as print pressure, print quality and print characteristics.

A method of printing onto a selected medium is described. A record corresponding to the selected medium is identified. The record defines at least one area having modified print attributes. Print control information associated with the record is retrieved. Printing is performed within one or more specified areas using modified print attributes and external to the specified area(s) using normal print attributes.

A printing system is also described. The printing system includes a storage device, a control circuit, and a print assembly. The storage device stores a record corresponding to a selected medium. The record defines at least one area having modified print attributes. Associated with the record is print control information. The control circuit is coupled to the storage device and controls a print operation based on the print control information associated with the record. The print assembly is coupled to the control circuit. The print assembly prints within the selected areas using modified print attributes and external to the selected areas using normal print attributes.

Also described is a computer implemented method for registering a record for a specific type of media. A selectable option for registering a selected medium type is displayed to a user. Record identifying information associated with the selected medium type is received as input. A selectable option for defining at least one area within a selected medium is displayed to the user. At least one area defining information is received as input. A selectable option for modifying at least one print attribute associated with the at least one area is displayed to the user.

A computer program on a computer-usable medium is also described. The computer program includes means for displaying to a user a selectable option for registering a selected medium type, a selectable option for defining at least one area within a selected medium of the selected medium type, and a selectable option for modifying at least one print attribute associated with the at least one area. The computer program includes means for creating a capability to receive as input record identifying information associated with the selected medium type and at least one area defining information.

Other objects, features, and advantages of the present invention will be apparent from the accompanying drawings and from the detailed description below.

BRIEF DESCRIPTION OF THE DRAWINGS

The present invention is illustrated by way of example and not limitation in the figures of the accompanying drawings, in which like references indicate similar elements, and in which:

FIG. 10 is a table illustrating a priority scheme associated with print attribute selections.

DESCRIPTION OF PREFERRED EMBODIMENT

A. System Configuration

Figure 1:
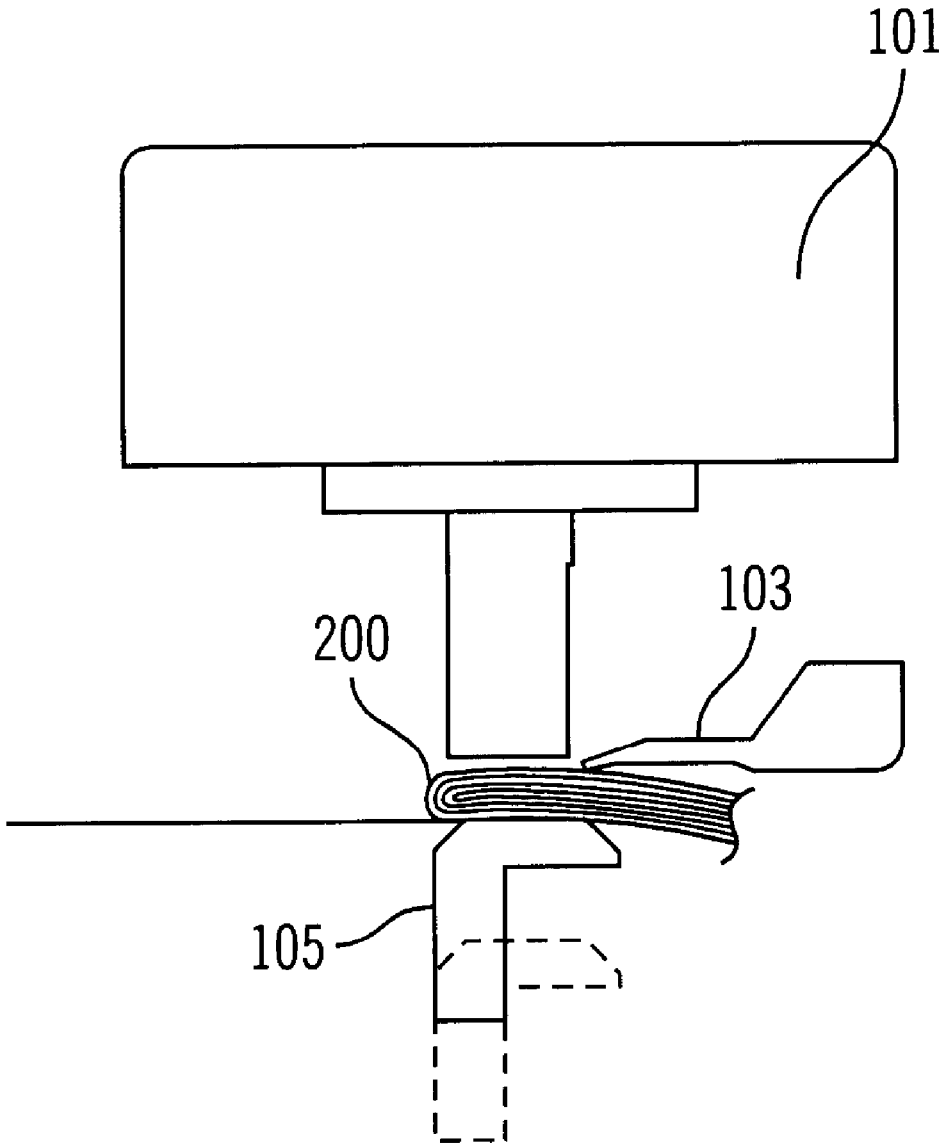
FIG. 1 illustrates a printing operation performed by a conventional printer.
Figure 5:
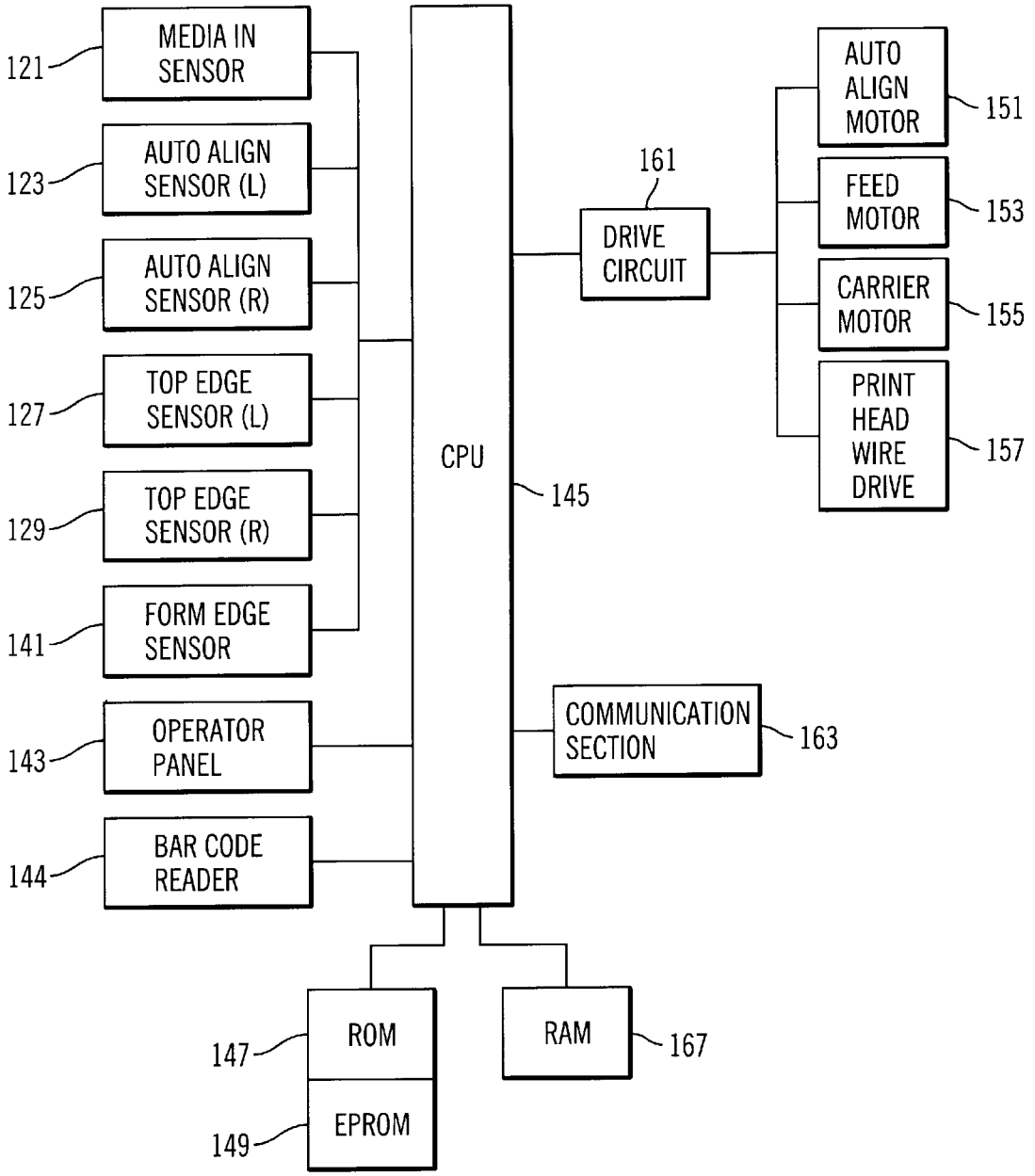
FIG. 5 illustrates a block diagram of a printer according to one embodiment of the present invention.

FIG. 1 illustrates a printer 100 with a medium 200 inserted according to one embodiment of the present invention. FIG. 5 illustrates a block diagram of the electronic components of the printer 100.

With respect to FIG. 5, CPU 145 is electrically coupled to various sensors 121, 123, 125, 127, 129, and 141, a drive circuit 161, an operator panel 143, and various memory devices 147, 149, and 167. The CPU 145 receives signals from the various sensors to control drive circuit 161 in accordance with a control program stored in the various memory devices. For one embodiment of the present invention, the CPU 145 and/or drive circuit 161 may be referred to as a control circuit. The operator panel 143 is used for the user input and includes a display panel.

Figure 4:
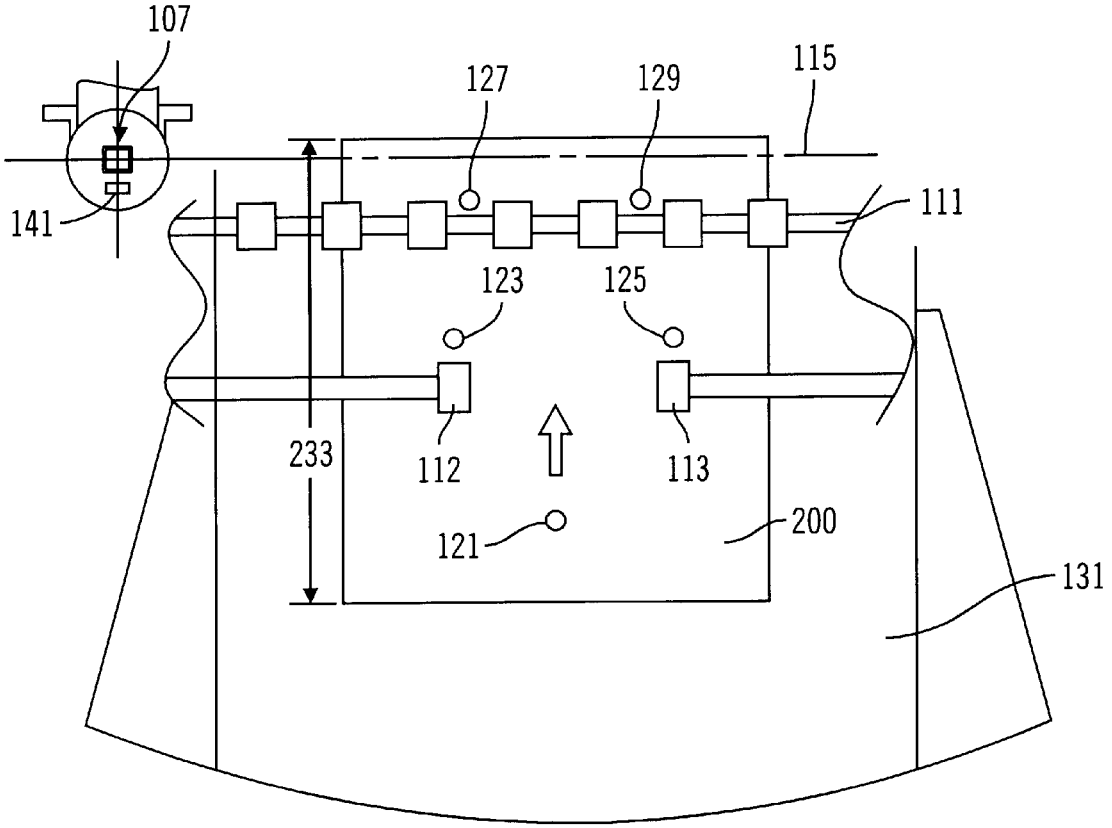
FIG. 4 illustrates a top view of a printer according to one embodiment of the present invention.

FIG. 4 illustrates components in the paper path of the printer. The media in sensor (i.e. an insertion entrance sensor) 121 detects the insertion of a medium 200, such as the paper, into printer 100. The top edge sensors 127 and 129 detect the top edge of medium 200 and detects paper paths errors such as a paper jam.

The auto align sensors 123 and 125 detect the skew of medium 200 inserted into printer 100. The form edge sensor 141 detects the position of the side edge and the lateral width of medium 200.

An auto align motor 151 (FIG. 5) corrects the skew of medium 200 by driving feed rollers 112 and 113 (FIG. 4) in a positive or negative direction. A feed motor 153 (FIG. 5) is for driving a feed roller assembly 111 (FIG. 4) in the positive or negative direction to feed the processed medium 200.

A carrier motor 155 (FIG. 5) drives a print carrier 107 (FIG. 4) in a right or left direction. A print head wire drive 157 (FIG. 5) includes coils for forming a magnetic drive circuit which are used to activate the print head wires. A drive circuit 161 controls the drive of the motors 151, 155 and print head wire drive 157. For one embodiment of the present invention, motors 151 and 153 and print head wire drive 157 may be referred to as a print assembly. A communication section 163 communicates with a host personal computer (PC).

B. Registration

The registration of a print control operation according to one embodiment of the present invention is described below.

Figure 6:
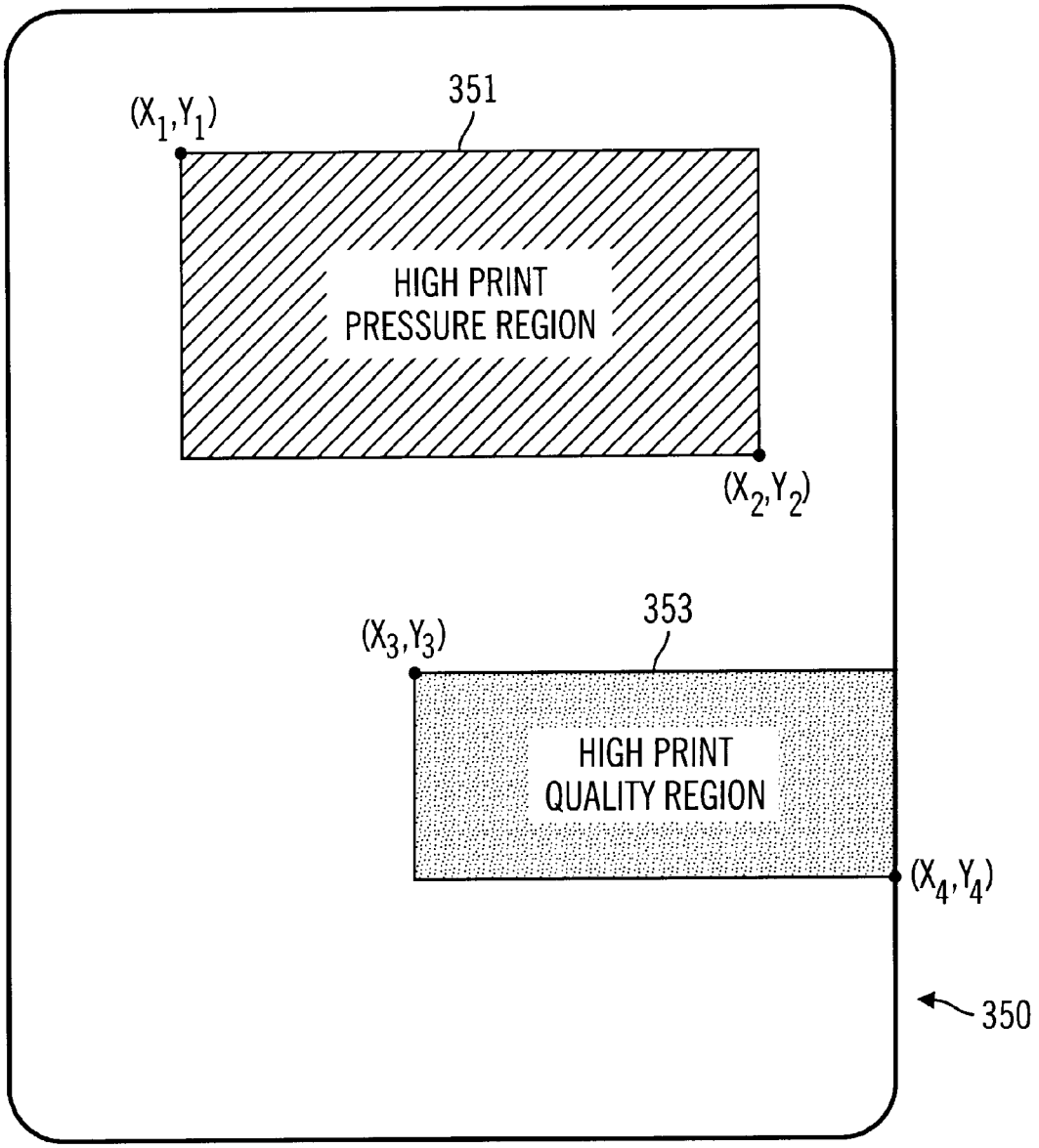
FIG. 6 illustrates an example of a medium having a high print pressure region and a high print quality region.

FIG. 6 illustrates an example of a medium 350 having a high print quality region 353 and a high print pressure region 351. Medium 350 represents a sheet or page of any type of print media. For example medium 350 may represent a passbook page. As shown in the FIG. 6, a white area is printed using a normal (default) print operation, an area 351 is printed using a high pressure print operation, and an area 353 is printed using a high quality print operation.

Figure 7:
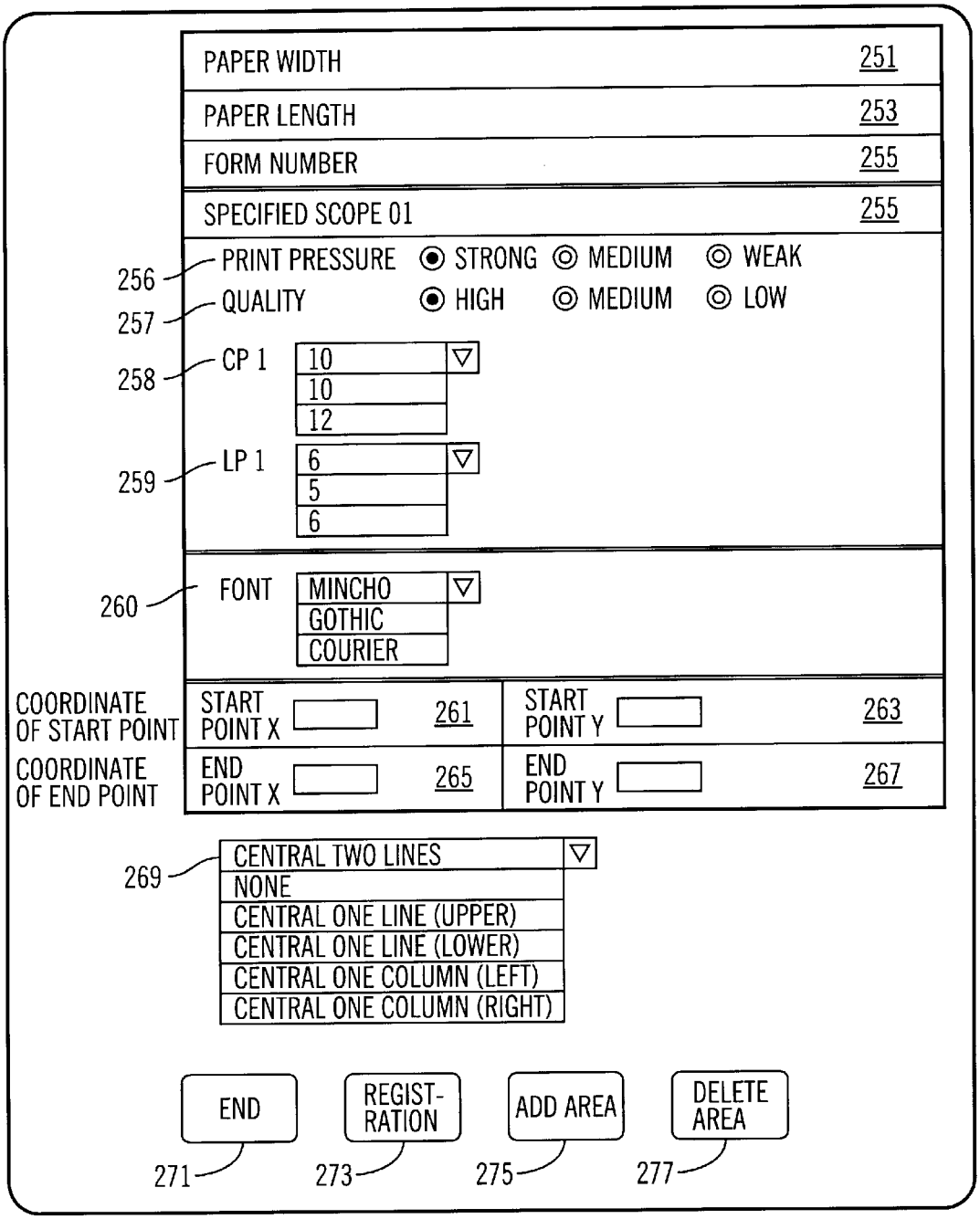
FIG. 7 illustrates a display window of a tool for registering a print control data table according to one embodiment of the present invention.

FIG. 7 shows a print control data window 250 of a tool for registering a print control data table according to one embodiment of the present invention.

Figure 8:
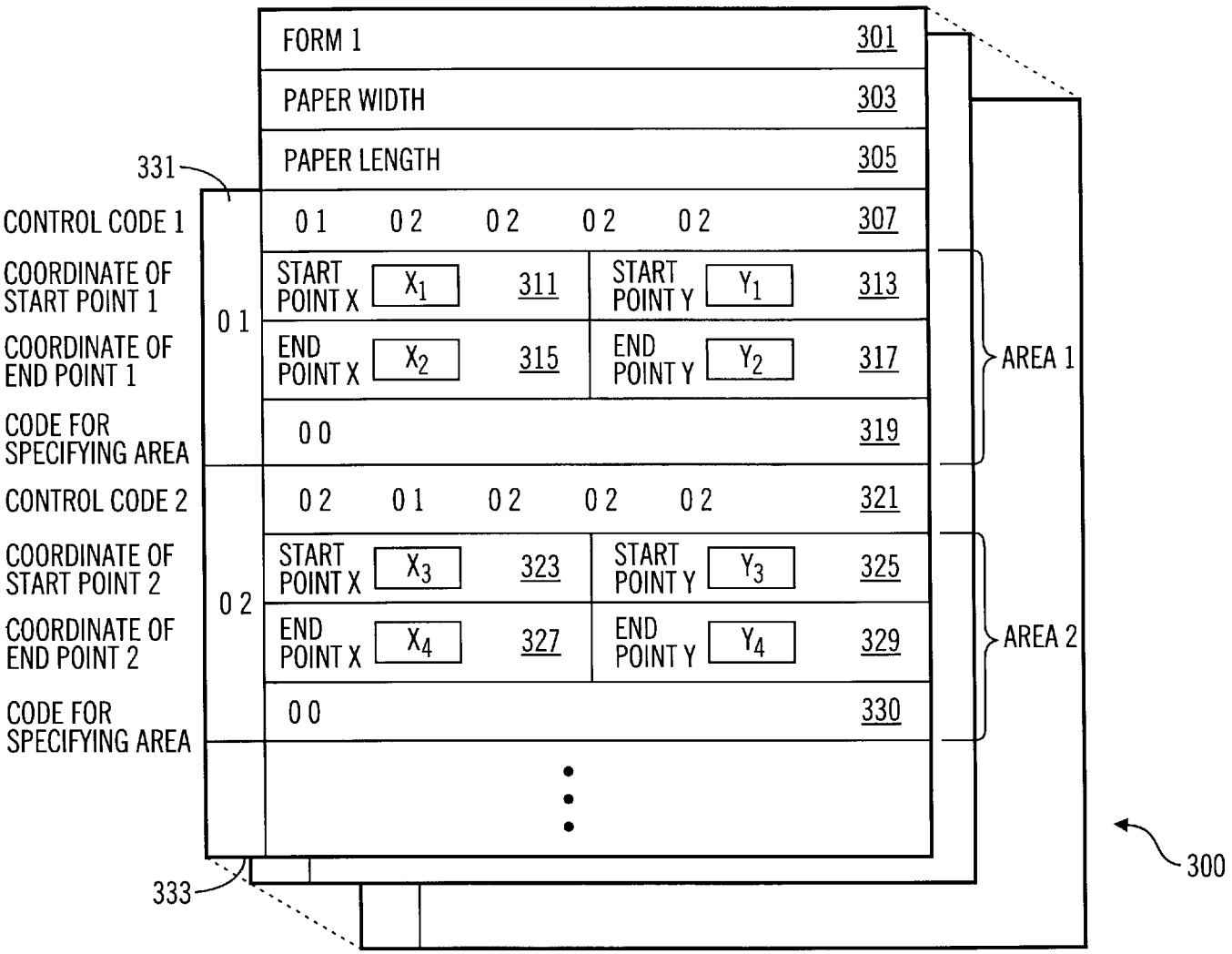
FIG. 8 illustrates a registered print control data table according to one embodiment of the present invention.

FIG. 8 illustrates one example of a registered print control data table 300. In the preferred embodiment of the present invention, print control data table 300 is registered in the host PC, and its contents are transmitted to printer 100 and stored in the RAM 167 in printer 100 at the start of printing.

Information for identifying the type of medium 200, such as a paper width 251, a paper length 253, a form number 255, is entered using the print control data window 250 shown in FIG. 7.

In one embodiment of the present invention, a bar coded form number is printed at a predetermined position on the medium 200. The bar coded form number is read by form edge sensor 141 (FIG. 4) as sensor 141 moves in the right and left directions across the bar coded form number. The form number is used to specify a corresponding record in print control data table 300. A print operation is made in accordance with control information assigned to the record.

In the case where a bar code is not printed on the medium, or a nonregistered bar code is printed on the medium paper, sensors are used to detect the paper width and the paper length. Furthermore, a corresponding record is retrieved, and a print operation is made in accordance with control information assigned to the record retrieved.

In one embodiment of the present invention, areas having modified print attributes modified can be specified by using the control data window 250 (FIG. 7) to set start points 261 and 263 and end points 265 and 267. A pull down menu 269, can be used to specify the area having modified print attributes without using start points 261 and 263 and end points 265 and 267.

The control data window 250 can also be used to set such modified print attributes print attributes a print pressure input 256, a print quality input 257, a print pitch (CPI: Character Per Inch) input 258, a line feed (LPI: Line Per Inch) input 259 and a font (a type face) input 260.

The medium 200 may include paper, a passbook, a cloth, and various resin sheets. The medium identifying information refers to any information that distinguishes the different types of the media, such as the size information, the form number, information obtained by converting them, a temperature, a reflectivity, a hardness, and a conductivity of the medium. The area defining information includes coordinate information indicating a start point and an end point of the area or position information indicating a relative position, such as the N lines from the center of the medium. The selectable print attributes includes information specifying the print pressure, the print quality, the print pitch, the line feed, and the font.

For one embodiment of the present invention, the sensor is a bar code reader for reading a bar coded medium identifying information.

For one embodiment of the present invention, the record identifying information represents the size information of the selected medium, and the sensor may comprise an optical sensor for detecting the size information of medium. The size information may include the width information and the length information of the medium. The size information indicates the degree of variation of the width and the length depending upon the position on the medium and the thickness information.

In the preferred embodiment of the present invention, the following management scheme is used when a plurality of areas overlap each other.

Referring to Table 1 shown in FIG. 10, when two areas having different attributes overlap each other, CPU 145 selects the description having the higher priority. This control is made within the printer. In the preferred embodiment of the present invention, the font size is fixed.

Referring to the FIG. 7 again, the four buttons, "END" button 271, "REGISTRATION" button 273, "ADD AREA" button 275 and "DELETE AREA" button 277 are provided for the operator. The "END" button 271 is used to close the window of the print control data table registration tool. The "REGISTRATION" button 273 is selected when registering a print control data table 300 shown in FIG. 8.

The "ADD AREA" button 275 is selected when inputting information representing the specified area or scope into print control data table 300. Additionally "ADD AREA" button 275 is used to increment the specified scope number in field 255 to the currently registered number +1, resetting the information in fields 256 through 259 to the default values, and resetting the information in fields 261 through 267 to receive operator input.

The "DELETE AREA" button 277 is used to delete information representing the specified scope from print control data table 300. When button 277 is selected, the data representing the specified scope is deleted, and the values of all the specified scope numbers 255 greater than the number for this deleted scope is decreased by the value 1.

Although it is possible for the operator to manually measure the paper width and the paper length of the medium and manually enter the measured values, a personal computer can store the paper width and the paper length of the medium measured by the printer and use the measured values. The manner for specifying the scope by the start/end points can be replaced by specifying one line/or column on the both sides of the central portion of the medium.

C-1. Chance of the Print Attributes

The five types of print attributes in the preferred embodiment of the present invention are the print pressure, the print quality, the print pitch (CPI), the line feed (LPI) and the font attributes. Although the technology for changing these print attributes at the printer side is well known in the art, it is briefly described herein below.

The print pressure can be changed by varying the drive pulse width applied to the print head. The pulse width is broader for high print pressure than that of the normal print pressure. For example, a print head of IBM 9068 printer uses a drive pulse width of 280 sec. at the normal print pressure, a drive pulse width of 300 sec. at the medium print pressure, and a drive pulse width of 330 sec. at the high print pressure to optimize print pressure while printing each line of the passbook.

The print quality is modified by changing the number of dots forming the printed character. The dot impact print head usually includes 24 pins, and the "Quality" print quality uses all the dots of the vertical 24 dots and the horizontal 24 dots to print one character. The "Normal" print quality uses a half or 12 dots in horizontal, and the print quality "Draft" uses ⅓ dots in horizontal.

The print pitch is modified by changing a set-up value representing the distance between the adjacent print dots. The line feed is modified by changing an amount of feed for each line of the feed motor to change an amount of paper feed for each line.

C-2. Identifying a Record Corresponding to a Medium

The record in print control data table 300 which corresponds to a print operation for a particular medium having modified print attributes may be identified by using one or more of the following criteria.

(1) the bar code;

(2) the width of the medium;

(3) the length of the medium; and (4) the inserted position of the medium.

C-2-1. Bar Code

In one embodiment of the present invention, a bar code is printed at a predetermined position of the medium. The bar code has a form number corresponding to the form number at field 301 shown in the FIG. 8. For this embodiment of the present invention, the print operation is made in accordance with the print attributes and control code defined in the record responding to form number in field 301.

C-2-2. Width of the Medium

When medium 200 is inserted into printer 100, a reflect type optical sensor (the form edge sensor) 141 (FIG. 4) mounted on a carrier 107 is moved above medium 200 along a print head path 115 which is perpendicular to the feed direction of medium 200 to detect both the right and left edges of medium 200 for measuring the paper width. The sensor 141 turns on at the right edge of medium 200 and turns off at the left edge of medium 200. This detected information is compared with the paper width defined in field 303 in print control data table 300. If CPU 145 determines that the detected width corresponds to a paper width defined in the field 303, the print operation is performed in accordance with the print attributes and control code defined by the corresponding record.

C-2-3. Total Length of the Medium

Before printing onto medium 200, medium 200 is fed, and the reflect type optical sensors 127, 129 and 121 (FIG. 4) mounted on a paper guide sense the upper edge and the lower edge of medium 200 to measure the paper length. Furthermore, in the preferred embodiment of the present invention, the left auto align sensor (L) 123 and the right auto align sensor (R) 125 are turned on, and the skew is corrected by the feed/skew correction rollers 112 and 113 before medium 200 is further fed. The feed length from the time, at which the top edge sensor L 127 or the top edge sensor R 129 turns on, to the time, at which media in sensor 121 turns off, is calculated to measure the total length of medium 200. After the measurement of the total length, the feed rollers are rotated in the reverse direction to feed medium 200 back to a standby position, and the print operation is performed by feeding medium 200 in the forward direction from the standby position.

Although the total length of medium 200 is measured by the two sensors, i.e. one of top edge sensors 127 and 129 and the media in sensor 121 in the preferred embodiment of the present invention, it is possible to measure the total length by one sensor, such as a sensor positioned between feed roller unit 111 and feed/skew correction rollers 112 and 113.

This detected information representing the total length is compared with the paper length defined in field 305 in print control data table 300. If CPU 145 determines that the detected length corresponds to paper length 305, the print operation is performed in accordance with the print attributes and control code defined by the corresponding record.

C-2-4. Inserted Position of the Medium

The insertion entrance of printer 100 in the preferred embodiment of the present invention is designed to have a wider width than the width of medium 200. Furthermore, medium 200 can be inserted at any position along the width of the insertion entrance to be correctly fed. The operator usually places medium 200 at a center of the insertion entrance. Preferred embodiments of the present invention can identify the type of medium 200 by detecting the position of medium 200 placed on the insertion entrance, as shown in FIG. 9.

Figure 9:
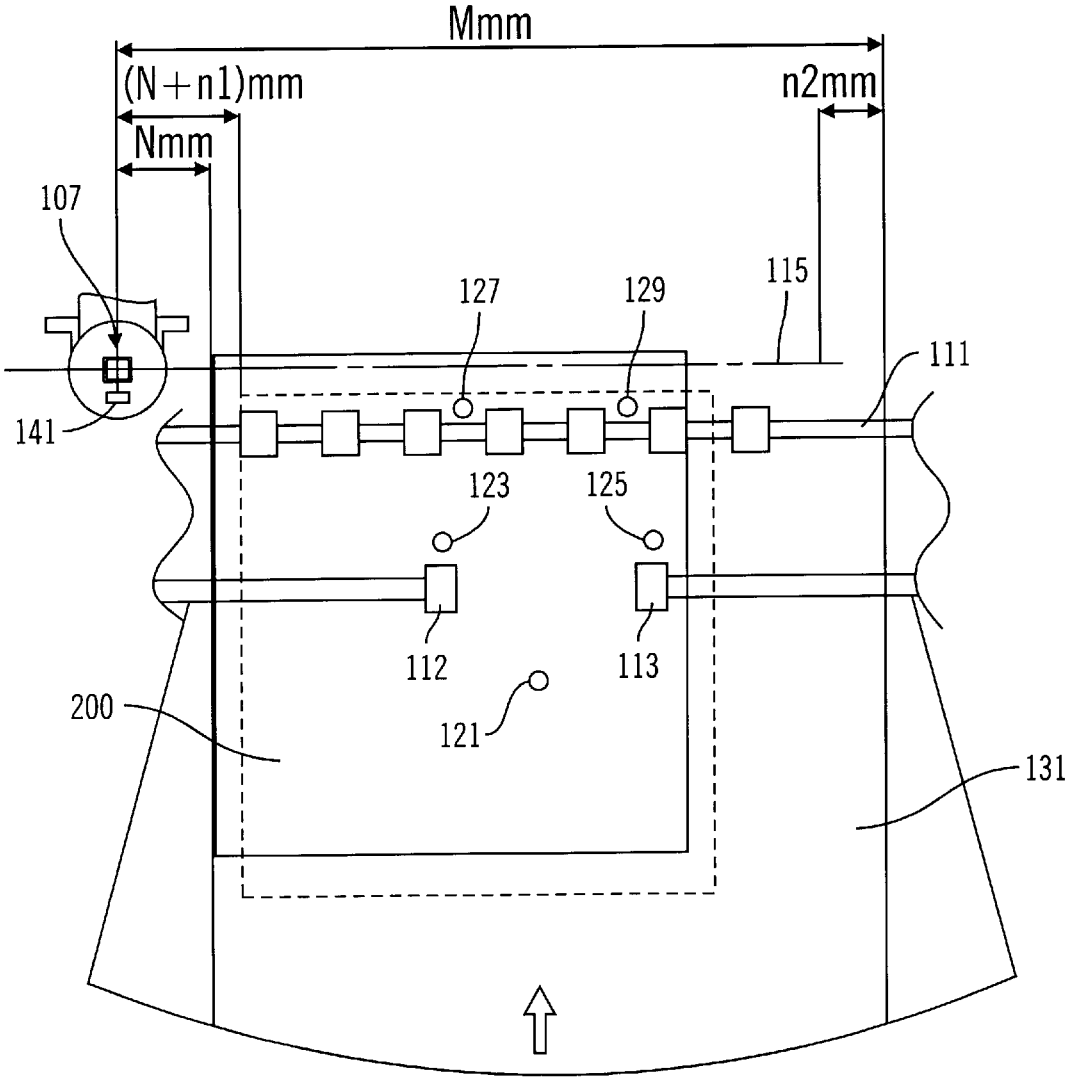
FIG. 9 illustrates a top view of a printer having a medium positioned at the insertion entrance of the printer according to one embodiment of the present invention.

Referring to FIG. 9, it is assumed that a distance between a standby position of print head carrier 107 and a left end of the insertion entrance is N mm. A first area is defined between a position apart from the standby position by the distance N mm and a position apart from the standby position by the distance N+n1 mm. The form edge sensor 141 moved along the print head path 115 detects the left edge or the right edge of the medium 200. When the left edge of the medium 200 is positioned within the first area, the print operation using the specified print attributes is made. When the left edge of the medium 200 is not positioned within the first area, a normal print operation is made.

In place of the first area, a second area can be used, which is defined between a position apart from the standby position by the distance M mm and a position apart from the standby position by the distance M-n2 mm. The distance M mm represents the distance defined between the standby position and a right edge of the insertion entrance. The values n1 and n2 can be zero. In this case, when the left edge of medium 200 is positioned at the left edge of the insertion entrance, or when the right edge of medium 200 is positioned at the right edge of the insertion entrance, the print operation with the specified print attributes can be made.

In the preferred embodiment of the present invention, form edge sensor 141 is first moved in the right and left direction above the position of a bar code of media 200. If the bar code is detected, the record corresponding to the detected form number is retrieved. If such record is found, the print operation is made in accordance with the print attributes and control code defined by the record. The vertical type bar code is used in the described embodiment. In the case where a lateral type bar code is used, the bar code can be read by stopping the sensor on the bar code and feeding the processed media.

In the case where the bar code is not detected or the record corresponding to the detected bar code is not found, both the width and length of media 200 are measured, and the record corresponding to both the detected width and length is retrieved. If the record is found, the print operation is made in accordance with the print attributes described in the record. If the record is not found, a normal print operation is performed.

Figure 2:
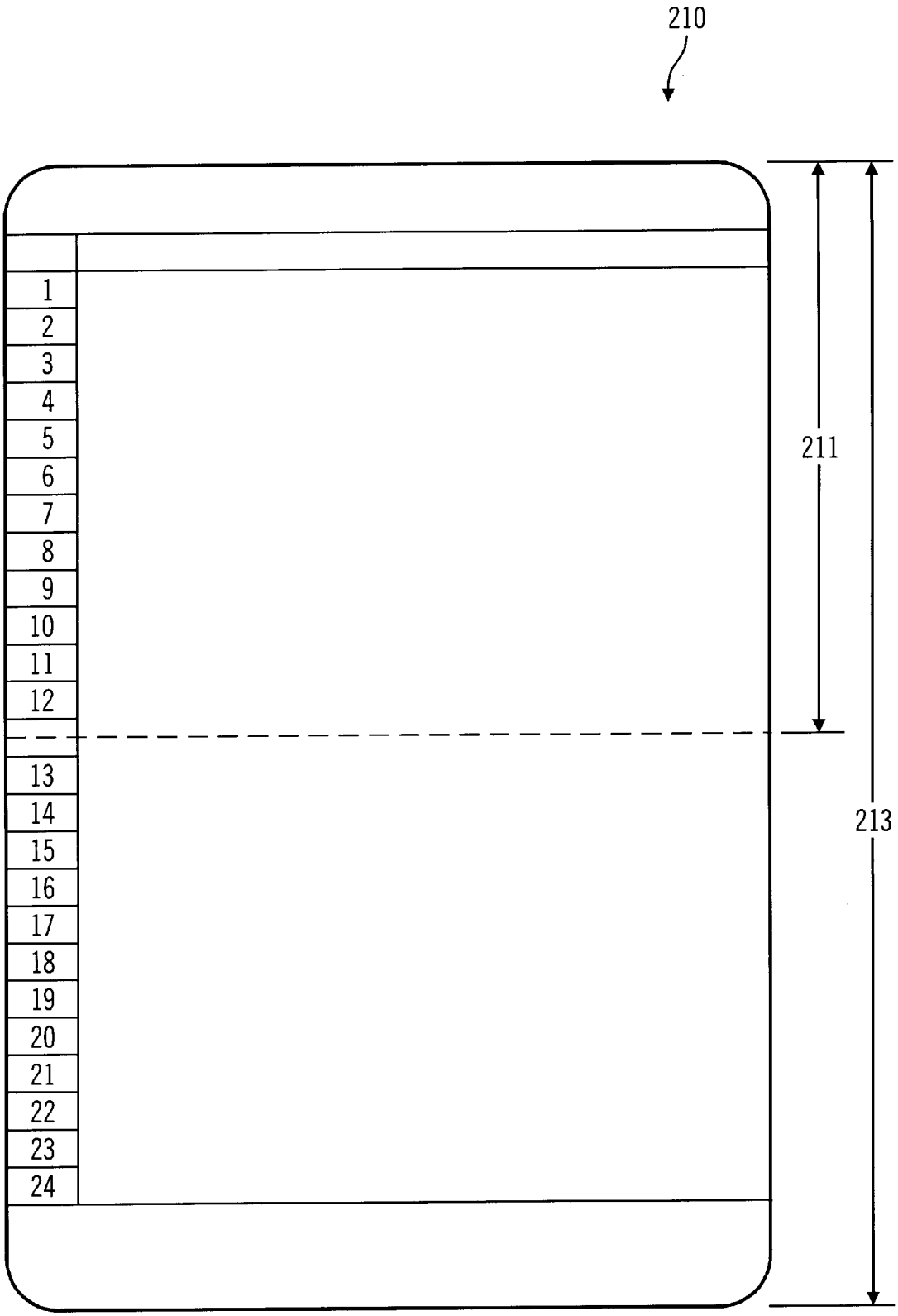
FIG. 2 illustrate a lateral type passbook.

In the case where a lateral type passbook 210, as shown in FIG. 2, is printed which includes the air layer above the lines 12 and 13 adjacent to the center folding line (shown by the dashed line in the FIG. 2), only the print lines above the air layer, such as the print lines 12 and 13, can be printed by using the high print pressure. In this case, it is possible to detect the positions of print lines 12 and 13 by detecting the distance from the top edge of passbook 210 to lines 12 and 13 since the center folding line is located at half the distance 211 of the total length 213 of passbook 210.

Figure 3:
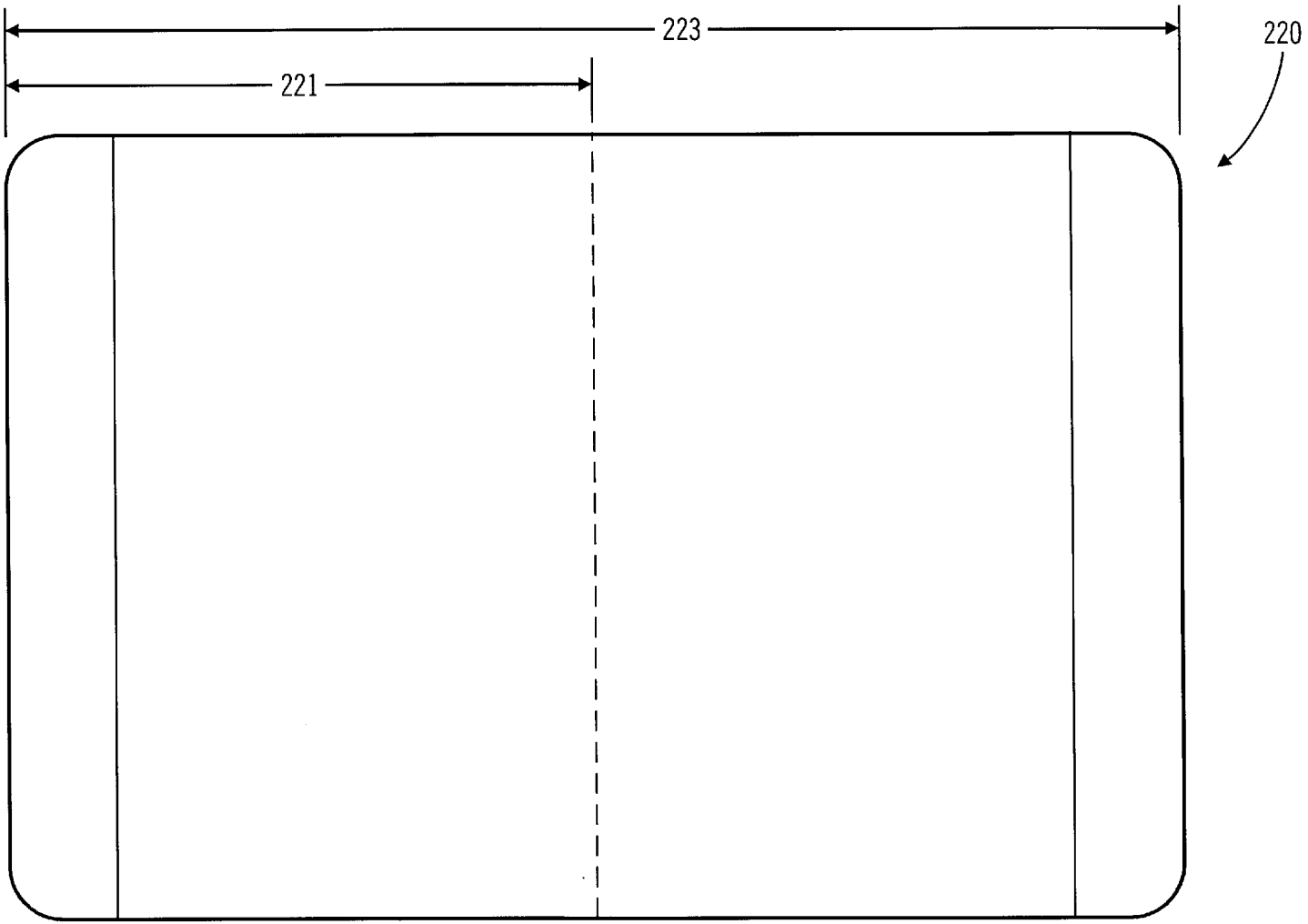
FIG. 3 illustrates a vertical type passbook.

In the case that the vertical type passbook 220, as shown in FIG. 3, is printed, it is possible to print only the characters adjacent to the center folding line by using the high print pressure. In this case, the center folding line is located at half the distance 221 of the total width 223 of passbook 220.

Using the foregoing specification, the invention may be implemented as a machine, process, or article of manufacture by using standard programming and/or engineering techniques to produce programming software, firmware, hardware or any combination thereof.

Any resulting programs(s), having computer readable program code, may be embodied within one or more computer usable media such as memory devices or transmitting devices, thereby making a computer program product or article of manufacture according to the invention. As such, the terms "article of manufacture" and "computer program product" as used herein are intended to encompass a computer program existent (permanently, temporarily, or transitorily) on any computer-usable medium such as on any memory device or in any transmitting device.

Executing program code directly from one medium, storing program code onto a medium, copying the code from one medium to another medium, transmitting the code using a transmitting device, or other equivalent acts, may involve the use of a memory or transmitting device which only embodies program code transitorily as a preliminary or final step in making, using or selling the invention.

Memory devices include, but are not limited to, fixed (hard) disk drives, diskettes, optical disks, magnetic tape, semiconductor memories such as RAM, ROM, Proms, etc. Transmitting devices include, but are not limited to, the internet, intranets, electronic bulletin board and message/note exchanges, telephone/modem-based network communication, hardwired/cabled communication network, cellular communication, radio wave communication, satellite communication, and other stationary or mobile network systems/communication links.

A machine embodying the invention may involve one or more printing systems and/or processing systems including, but not limited to, cpu, memory/storage devices, communication links, communication/transmitting devices, servers, I/O devices, or any subcomponents or individual parts of one or more printing systems and/or processing systems, including software, firmware, hardware or any combination or subcombination thereof, which embody the invention as set forth in the claims.

One skilled in the art of computer science will easily be able to combine the software created as described with appropriate general purpose or special purpose computer hardware and/or printer hardware to create a computer/printer system and/or computer/printer subcomponents embodying the invention and to create a compute/printer system and/or computer/printer subcomponents for carrying out the method of the invention.

While the preferred embodiment of the present invention has been illustrated in detail, it should be apparent that modifications and adaptations to that embodiment may occur to one skilled in the art without departing from the spirit or scope of the present invention as set forth in the following claims.

What is claimed is:

1. A method of printing onto a selected medium, comprising:

(a) detecting a characteristic of said selected medium;

(b) identifying a record corresponding to said detected characteristic, said record defining at least one area associated with a first set of print attributes;

(c) printing within said at least one area of said selected medium using said first set of print attributes defined in the identified record; and (d) printing on said selected medium external to said at least one area using a second set of print attributes.

2. The method of claim 1, wherein said record corresponding to said detected characteristic is identified based on record identifying information, said record identifying information including at least one of a length of said selected medium, a width of said selected medium, a form number for said selected medium, and an inserted position of said selected medium.

3. The method of claim 1, wherein the characteristic of said selected medium is detected by measuring a length of said selected medium and wherein the record is identified by determining one record having length identifying information equivalent to said measured length of said selected medium.

4. The method of claim 1, wherein the characteristic of said selected medium is detected by measuring a width of said selected medium and wherein the record is identified by determining one record having width identifying information equivalent to said measured width of said selected medium.

5. The method of claim 1, wherein the characteristic of said selected medium is detected by reading a form number from said selected medium and wherein the record is identified by determining one record having form number identifying information equivalent to said read form number of said selected medium.

6. The method of claim 1, wherein the first set of print attributes includes at least one of a print pressure attribute, a print quality attribute, and a print characteristic.

7. The method of claim 6, further comprising prior to step (a):

(e) storing record identifying information, area defining information, and said first set of print attribute information for said record corresponding to said selected medium.

8. The method of claim 7, further comprising prior to step (e):

(f) receiving record identifying information, area defining information, and said first set of print attribute information for said record corresponding to said selected medium.

9. The method of claim 1, wherein the characteristic of said selected medium is detected by detecting a position of said selected medium at an insertion entrance of a printer and wherein the record is identified by determining one record having inserted position identifying information equivalent to said detected position of said selected medium at said insertion entrance of said printer.

10. The printing system of claim 1, wherein the detecting device measures a length of said selected medium and wherein the processor identifies the record by determining one record having length identifying information equivalent to said measured length of said selected medium.

11. The printing system of claim 1, wherein the detecting device measures a width of said selected medium and wherein the processor identifies the record by determining one record having width identifying information equivalent to said measured width of said selected medium.

12. The printing system of claim 1, wherein the detecting device reads a form number from said selected medium and wherein the processor identifies the record by determining one record having form number identifying information equivalent to the form number read from said selected medium.

13. The printing system of claim 1, wherein the detecting device detects a position of said selected medium at an insertion entrance of a printer and wherein the processor identifies the record by determining one record having inserted position identifying information equivalent to said detected position of said selected medium.

14. A method of printing onto a selected medium, comprising:

(a) detecting a position of said selected medium at an insertion entrance of a printer;

(b) identifying a record having inserted position identifying information equivalent to said position of said selected medium at said insertion entrance of said printer, said record defining at least one area having modified print attributes, said record having associated print control information;

(c) retrieving print control information associated with said record;

(d) printing within said at least one area of said selected medium using said modified print attributes; and (e) printing on said selected medium external to said at least one area using normal print attributes.

15. A printing system, comprising:

a storage device for storing at least one record corresponding to a selected medium, said record defining at least one area associated with a first set of print attributes;

a detecting device for detecting a characteristic of said selected medium;

a processor coupled to said detecting device and said storage device, wherein said processor is capable of identifying a record in said storage device corresponding to said detected characteristic, said record defining at least one area associated with a first set of print attributes;

a print assembly coupled to said processor, said print assembly operable to print within said at least one area of said selected medium using said first set of print attributes defined in the identified record and operable to print onto said selected medium external to said at least one area using a second set of print attributes.

16. The printing system of claim 15, wherein said first set of print attributes includes at least one of a print pressure attribute, a print quality attribute, and a print characteristic.

17. The printing system of claim 15, wherein said record corresponding to said detected characteristic is identified based on record identifying information, said record identifying information including at least one of a length of said selected medium, a width of said selected medium, a form number of said selected medium, and an inserted position of said selected medium.

18. A program embedded in a computer readable medium for causing a printer to print onto a selected medium, wherein the program is capable of causing a processor to perform:

(a) receiving a detected characteristic of said selected medium;

(b) identifying a record corresponding to said detected characteristic, said record defining at least one area associated with a first set of print attributes;

(c) causing a printer to print within said at least one area of said selected medium using said first set of print attributes defined in the identified record; and (d) causing a printer to print on said selected medium external to said at least one area using a second set of print attributes.

19. The program of claim 18, wherein said record corresponding to said detected characteristic is identified based on record identifying information, said record identifying information including at least one of a length of said selected medium, a width of said selected medium, a form number of said selected medium, and an inserted position of said selected medium.

20. The program of claim 18, wherein the characteristic of said selected medium is detected by measuring a length of said selected medium and wherein the record is identified by determining one record having length identifying information equivalent to said measured length of said selected medium.

21. The program of claim 18, wherein the characteristic of said selected medium is detected by measuring a width of said selected medium and wherein the record is identified by determining one record having width identifying information equivalent to said measured width of said selected medium.

22. The program of claim 18, wherein the characteristic of said selected medium is detected by reading a form number from said selected medium and wherein the record is identified by determining one record having form number identifying information equivalent to said read form number of said selected medium.

23. The program of claim 18, wherein the characteristic of said selected medium is detected by detecting a position of said selected medium at an insertion entrance of a printer and wherein the record is identified by determining one record having inserted position identifying information equivalent to said detected position of said selected medium at said insertion entrance of said printer.

24. The program of claim 18, wherein the first set of print attributes includes at least one of a print pressure attribute, a print quality attribute, and a print characteristic.

* * * * *

UNITED STATES PATENT AND TRADEMARK OFFICE

CERTIFICATE OF CORRECTION

PATENT NO. : 6,203,220 B1
DATED : March 20, 2001
INVENTOR(S) : Hiroyuki Takenoshita and Tsutomu Sawa It is certified that error appears in the above-identified patent and that said Letters Patent is hereby corrected as shown below:

Column 4,
Line 54, after "5," insert -- a --.

Column 5,
Line 64, after "attributes" delete "modified."
Line 64, after "specified" delete "by."

Column 6,
Line 4, delete "print attributes" insert -- as --.
Line 66, delete "values" insert -- value --.

Signed and Sealed this

Fifth Day of April, 2005

JON W. DUDAS
*Director of the United States Patent and Trademark Office*